United States Patent [19]

Felt

[11] Patent Number: 4,786,785

[45] Date of Patent: Nov. 22, 1988

[54] METHOD AND APPARATUS FOR SECURE STORAGE OF VALUABLES

[75] Inventor: Dennis J. Felt, Cambridge, Ohio

[73] Assignee: NCR Corporation, Dayton, Ohio

[21] Appl. No.: 83,403

[22] Filed: Aug. 10, 1987

[51] Int. Cl.[4] ..... B65D 21/00

[52] U.S. Cl. ..... 235/7 R; 235/1 R; 206/0.83; 220/23.83; 312/211; 312/291; 312/308; 312/333

[58] Field of Search ..... 235/7 A, 7 R, 10, 22, 235/27, 1 R; 206/0.81–0.83; 220/23, 23.83, 23.86; 312/246, 308, 330 R, 211, 291, 333

[56] References Cited

U.S. PATENT DOCUMENTS

| | | | |
|---|---|---|---|
| 2,508,283 | 5/1950 | Nelson et al. | 312/146 |
| 2,735,541 | 2/1956 | Mosler | 206/0.81 |
| 3,292,849 | 12/1966 | Ewing | 232/43.2 |
| 4,314,632 | 2/1982 | Hutchinson | 206/0.81 |
| 4,412,709 | 11/1983 | Ishii | 206/0.81 |
| 4,452,390 | 6/1984 | West | 232/4 R |

*Primary Examiner*—B. R. Fuller

*Attorney, Agent, or Firm*—Wilbert Hawk, Jr.; Albert L. Sessler, Jr.

[57] ABSTRACT

A cash till, a slip tray and a till lid are positioned in a cash drawer of a point of sale terminal or cash register for use in making change and receiving valuables during operation of the terminal or register by a clerk. At the end of the clerk's shift, the cash till, slip tray and till lid are removed, repositioned relative to each other, and locked together to form a secure container for transportation and storage of the valuables contained therein.

10 Claims, 4 Drawing Sheets

METHOD AND APPARATUS FOR SECURE STORAGE OF VALUABLES

BACKGROUND OF THE INVENTION

As is well known, a number of different clerks, at different times, may operate a single point of sale terminal or cash register in a retail or other establishment. For reasons of accountability, it is important that the accounts and the funds of each clerk remain separate from those of other clerks. One way in which this may be done is for each clerk, at the end of his or her shift, to place the contents of the cash till and an associated slip tray which may hold credit card slips, large bills, receipts and the like in a bag which can be stored in a remote location. However, this is an inconvenient arrangement, since the contents of the bag must then be removed, sorted, and replaced in the cash till and slip tray at the beginning of the next shift. Another way in which this may be done is for each clerk, at the end of a shift, to remove the cash till and slip tray which he or she has used from the terminal or register and transport it to a separate safe or other secure facility, so that the clerk coming on duty can place his or her own till in the cash drawer of the terminal or cash register and use it for taking in and maintaining his or her own balance of funds during that working shift.

If the individual tills and slip trays of the various clerks are not each secure against spillage or unauthorized access, it is possible that funds can be lost from an individual till or slip tray or transferred improperly from one till or slip tray to another either by accident or by improper action of some person either when the till and slip tray are being transferred from the point of sale terminal to the safe or during opening and closing of the safe when other tills and slip trays are being placed therein or removed therefom.

It has previously been known to place a lid on a cash till during such removal and storage, which lid may be attached to the till and locked in place to protect its contents. However, the slip tray has not been included in this arrangement, and its contents have been left unprotected.

Accordingly, the provision of means for securing the contents of both a cash till and a slip tray against loss provides a significant advantage in the operation of a business establishment having a plurality of sales clerks in which the cash tills and slip trays must, from time to time, be removed from a point of sale terminal and stored elsewhere.

SUMMARY OF THE INVENTION

The present invention relates to a method and apparatus for secure storage of valuables and more particularly relates to a cash till and slip tray structure and method of use for safeguarding valuables contained in said structure.

In accordance with a first embodiment of the invention, a method for securing valuables taken from a business machine cash drawer for transportation and storage, said valuables being placed in compartments in a till, having engaging means at one side of said till and having locking menas at a second side of said till, and a slip trap, having first engaging means at one side adapted to engage with the engaging means of the till, having second engaging means at said one side and having an aperture at a second side in position corresponding to the locking means of the till, within the cash drawer during operation of the business machine, the till being placed in the cash drawer above a slip tray which in turn is placed above a till lid, having engaging menas at one side to engage with the second engaging means of the slip tray and having a lock at a second side adapted to engage with the locking means of the till, during operation of the business machine, comprises the following steps: removing the till, the slip tray and the till lid from the cash drawer of the business machine, with accumulated valuables placed in the compartments of the till and slip tray; positioning the slip tray above and in alignment with the till; positioning the till lid above and in alignment with the slip tray; and locking the till lid to the till with the slip tray therebetween, whereby the valuables are held secured within the locked assembly.

In accordance with a second embodiment of the invention, a security container for receiving valuables when located in a business machine cash drawer and for storing said valuables in a secure condition, comprises a till having a configuration to enable it to be placed within said business machine cash drawer, having engaging means at one side of said till, and having locking menas at a second side of said till; a slip tray having a configuration to enable it to be placed below the till in said business machine cash drawer for receiving documents taken in by the user of a business machine in the course of business, having first engaging means at one side adapted to engage with the engaging means of the till, having second engaging means at said one side and having an, aperture at a second side in position corresponding to the locking means of the till; and a till lid having a configuration to enable it to be placed below the slip tray in said business machine cash drawer, having engaging means at one side adapted to engage with the second engaging means of the slip tray, and having locking means a second side adapted to engage with the locking means of the till, whereby the three elements comprising the till, the till lid and the slip tray can be removed from the business machine cash drawer, and assembled with the slip tray between the till and the till lid, with the engaging means of the till lid engaging with the second engaging means of the slip tray and with the first engaging means of the slip tray engaging with the engaging means of the till to retain all three elements in assembled relation at one side, and with the locking means of the till lid acting through the aperture of the slip tray to engage the locking means of the till to retain all three elements in assembled relation at the other side, so that the contents of the till and the slip tray are safeguarded for transportation and storage.

It is accordingly an object of the present invention to provide a method for secure storage of valuables.

Another object is to provide an apparatus for secure storage of valuables.

Another object is to provide a method for secure storage of valuables comprising removing elements of a container from a cash drawer of a point of sale terminal or cash register, repositioning the elements with respect to each other, and locking the elements together to provide a secure container.

Another object is to provide a security container for valuables comprising a till, a slip tray and a till lid which can be assembled to provide a secure container.

With these and other objects, which will become apparent from the following description, in view, the invention includes certaih novel features of construction and combinations of parts, preferred forms or embodiments of which are hereinafter described with reference to the drawings which accompany and form a part of this specification.

DETAILED DESCRIPTION

Figure 1:
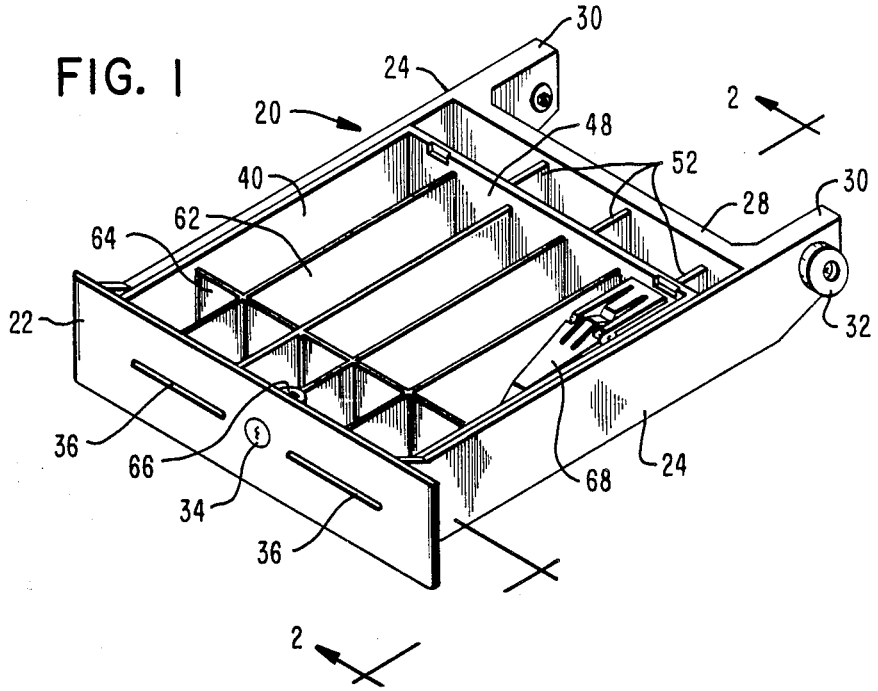
FIG. 1 is a perspective view of a cash drawer of a point of sale terminal having therein a cash till assembly, including a till, a till lid and a slip tray, which comprises the elements of a security container.
Figure 2:
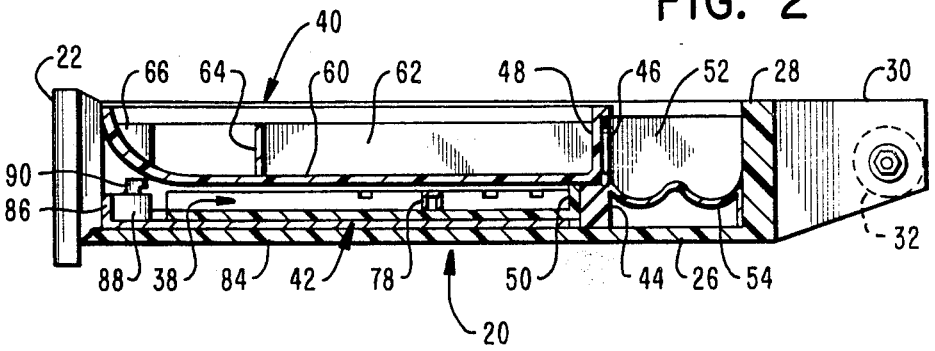
FIG. 2 is a sectional view taken along line 2—2 of FIG. 1.
Figure 3:
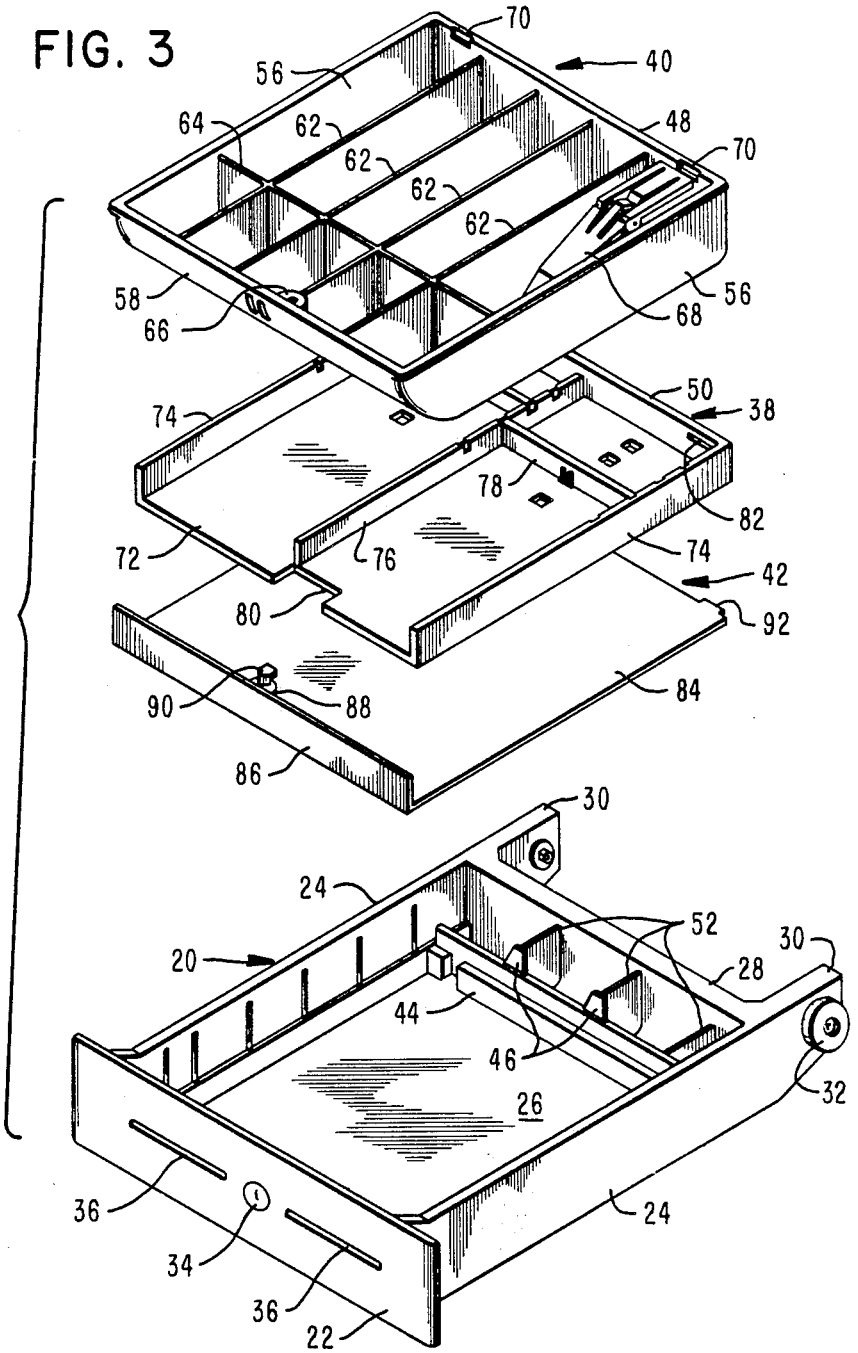
FIG. 3 is an exploded perspective view showing the various elements of the security container of the present invention in the relative positions in which they are located when positioned with a cash drawer.

Referring now to FIGS. 1, 2 and 3, shown there is a typical cash drawer 20 of a point of sale terminal or cash register. The cash drawer 20 includes a face plate 22, side walls 24, a floor 26, a rear wall 28 and extensions 30 of the side walls 24 on which are mounted rollers 32 which cooperate with complementary tracks or other elements (not shown) in the drawer aperture in the terminal or cash register for drawer alignment purposes. The face plate 22 is provided with a lock 34 to enable the drawer 20 to be locked in a closed position within the terminal or cash register, and is also provided with a pair of slots 36, through which documents may be inserted into a slip tray 38 which is positioned in the cash drawer 20 below a cash till 40 and above a till lid 42.

As best shown in FIGS. 2 and 3, an internal wall 44, having upward extensions 46, is provided within the cash drawer 20, and is positioned to cooperate with a rear wall 48 of the till 40 and a rear wall 50 of the slip tray 38. Cross members 52 and a curved floor 54 define a plurality of individual compartments in the cash drawer, which may be used for coin storage or other appropriate purposes.

As best shown in FIG. 3, the till 40, in addition to the rear wall 48, includes side walls 56, a curved front wall 58, a floor 60, internal dividers 62, 64, and a lock keeper 66 which cooperates with a lock 88 on the till lid 42 in a manner which will subsequently be described. A bill retainer 68 may be positioned in one or more of the compartments defined by dividers 62, 64. Slots 70 are provided in the rear wall 48 for a purpose which will subsequently be described.

The slip tray 38, in addition to the rear wall 50, includes a floor 72, side walls 74, a plurality of dividers 76, 78, and a cut-out portion 80 located to eliminate interference with cooperating locking elements on the till 40 and the till lid 42, as will subsequently be described. Two projections 79 (FIGS. 4, 5 and 6) are positioned on the outside surface of the rear wall 50 so as to be engageable with the slots 70 of the till 40. Slots 82 are provided in the rear wall 50 for a purpose which will subsequently be described.

Figure 5:
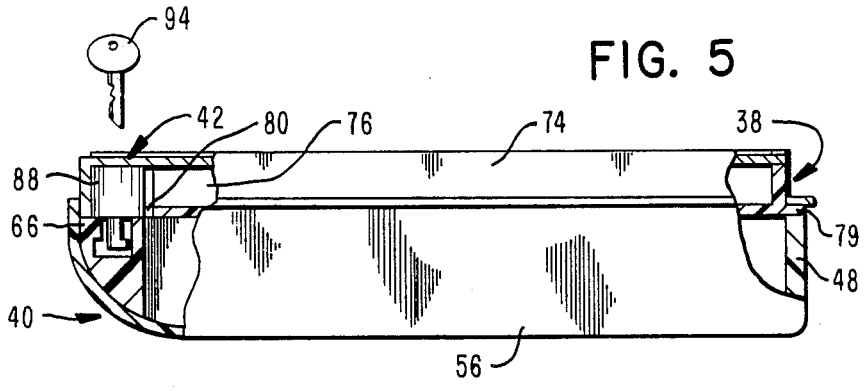
FIG. 5 is an elevation view, partly in section, of an assembled security container.
Figure 6:
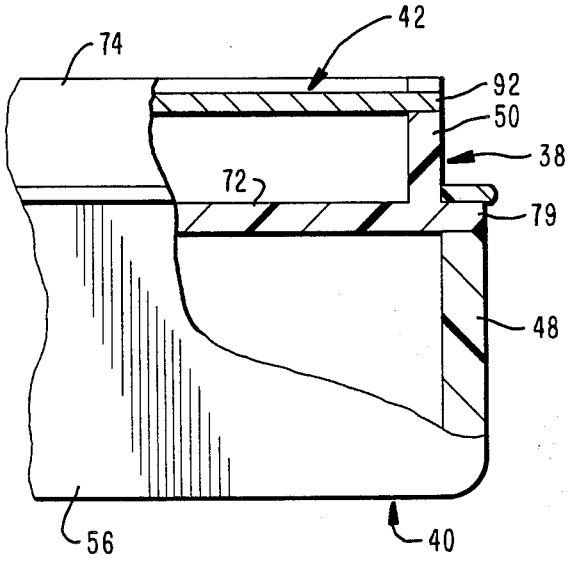
FIG. 6 is an enlarged fragmentary view showing details of the means for releasably securing together the till, the slip tray and the till lid, at one side thereof.

The till lid 42 includes a cover 84, a front wall 86 and a lock 88 positioned adjacent the front wall 86 and having a locking element 90 extending therefrom. A pair of projections 92 extend from the rear edge of the cover 84 and are so positioned and configured as to extend through the slots 82 of the slip tray 42 when the elements 38, 40 and 42 are in assembled relation, as shown in FIG. 5.

As shown in FIGS. 1 and 2, when the elements of the security container are placed in the cash drawer 20 for use by a clerk in connection with the operation of a point of sale terminal or cash register, the till lid 42 is disposed on the floor 26 of the cash drawer 20, with the slip tray 38 placed on and above the till lid 42, and the till 40, in turn, placed on and above the slip tray 38. When a transaction is rung up on the point of sale terminal or cash register, the drawer 20 is released and moves outwardly from the terminal or register, so that the clerk can use it to deposit the funds tendered by a customer and to make change, if necessary. Coins and bills can be deposited in the compartments of the till 40, which are defined by the dividers 62, 64. Documents, such as credit card slips, can be inserted into the slots 36 of the front face 22 of the cash drawer 20 and will repose in the compartments of the slip tray 38, which are defined by the dividers 76, 78.

Figure 4:
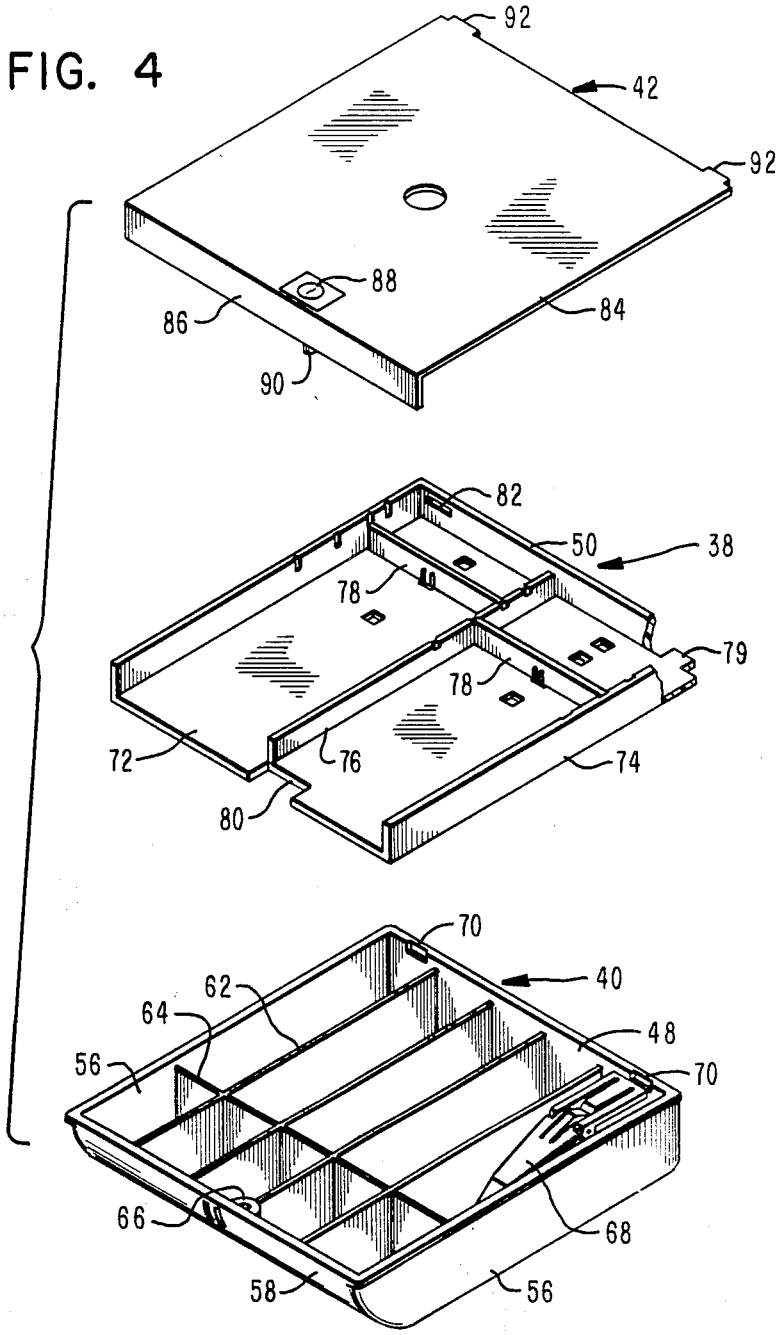
FIG. 4 is an exploded perspective view showing the various elements of the security container of the present invention in the relative positions in which they are located for assembly as a security container.

When the clerk goes off duty, the till 40, the slip tray 38 and the till lid 42 are removed from the cash drawer 20 and are repositioned relative to each other in the relative positions shown in FIG. 4, with the till 40 at the bottom, the slip tray 38 above the till 40, and the till lid 42 above the slip tray 38. The slip tray 38 fits above and slightly within the side walls 56 and rear wall 48 of the till 40, so that the projections 79 on the rear wall 50 of the slip tray 38 engage with the slots 70 in the rear wall 48 of the till 40. The till lid 42 is then positioned over the assembled elements 38 and 40 and the projections 92 on the cover 84 of the till lid 42 are placed through the slots 82 of the slip tray 38. The locking element 90 of the lock 88 of the lid 42 is permitted by the cut-out portion 80 of the floor 72 of the slip tray 38 to engage the lock keeper 66 of the till 40. The lock 88 can then be operated by a key 94 or other suitable means to cause the locking element 90 to engage the lock keeper 66 of the till 40 to lock together the elements 38, 40 and 42. The assembled security container comprising the elements 38, 40, 42 can then be transported and stored until next required for use by the clerk with the assurance that its contents will not be readily accessible to any unauthorized person who does not have the key 94 or other means to operate the lock 88.

While the forms of the invention shown and described herein are admirably adapted to fulfill the objects primarily stated, it is to be understood that it is not intended to confine the invention to the forms or embodiments disclosed herein for it is susceptible of embodiment in various other forms within the scope of the appended claims.

What is claimed is:

1. A method for securing valuables taken from a business machine cash drawer for transportation and storage, said valuables being placed in compartments in a till, having engaging means at one side of said till and having locking menas at a second side of said till, and a slip tray, having first engaging means at one side adapted to engage with the engaging means of the till, having second engaging means at said one side and having an aperture at a second side in position corresponding to the locking means of the till, within the cash drawer during operation of the business machine, the till being placed in the cash drawer above said slip tray which in turn is placed above a till lid, having engaging means at one side to engage with the second engaging menas of the slip tray and having a lock at a second side adapted to engage with the locking means of the till, during operation of the business machine, comprising the following steps:

removing the till, the slip tray and the till lid from the cash drawer of the business machine, with accumulated valuables placed in the compartments of the till and slip tray;

positioning the slip tray above and in alignment with the till; and locking the till lid to the till with the slip tray therebetween, whereby the valuables are held secured within the locked assembly.

2. The method of claim 1 in which the locking step includes the steps of engaging one side of the till lid with a corresponding side of the slip tray and engaging said side of the slip tray with a corresponding side of the till, and locking the lock at the other side of the till lid to the locking means of the till, the aperture of the slip tray avoiding interference with said lock.

3. The method of cliam 2, in which the engaging menas of said till lid comprise projections and the second engaging means of said slip tray comprise complementary slots, and in which the step of engaging of one side of the till lid with a corresponding side of the slip tray comprises placing projections on one side of the till lid into complementary slots in the slip tray.

4. The method of claim 2, in which the first engaging menas of said slip tray comprise projections and the engaging means of said till comprise complementary slots, and in which the step of engaging of one side of the slip tray with a corresponding side of the till comprises placing projections on one side of the slip tray into complementary slots in the till.

5. The method of cliam 2, in which the lock is a key-operated lock.

6. A security container for receiving valuables when located in a business machine cash drawer and for storing said valuables in a secure condition, comprising:

a till having a configuration to enable said till to be placed within said business machine cash drawer, having engaging means at one side of said till, and having locking means at a second of said till;

a slip tray having a configuration to enable said tray to be placed below the till in said business machine cash drawer for receiving documents taken in by a user of the business machine in the course of business, having first engaging means at one side adapted to engage with the engaging means of the till, having second engaging means at said one side, and having an aperture at a second side in position corresponding to the locking menas of the till; and a till lid having a configuration to enable said lid to be placed below the slip tray in said business machine cash drawer, having engaging means at one side adapted to engage with the second engaging means of the slip tray, and having locking means at a second side adapted to engage with the locking means of the till, whereby the till, the till lid and the slip tray can be removed the business machine cash drawer, and assembled as three interlocking elements with the slip tray between the till and the till lid, with the engaging means of the till lid engaging with the second engaging menas of the slip tray and with the first engaging means of the slip tray engaging with the engaging means of the till to retain all three elements in assembled relation at one side, and with the locking menas of the till lid acting through the aperture of the slip tray to engage the locking means of the till to retain all three elements in assembled relation at the other side, so that the contents of the till and the slip tray are safeguarded for transportation and storage.

7. The security container of claim 6 in which the engaging means of the till comprises at least one slot, in which the first engaging means of the slip tray comprises at least one projection arranged to engage said at least one slot of the till when the two elements are assembled, in which the second engaging means of the slip tray comprises at least one slot, and in which the engaging means of the till lid comprises at least one projection arranged to extend through said at least one slot of the slip tray when the three elements are assembled.

8. The security container of claim 6 in which the locking means of the till lid comprises a lock having a depending member which extends through the aperture in the slip tray and engages the locking means of the till when the three elements are in assembled relation in order to secure them against unauthorized separation.

9. The security container of claim 8 in which the lock is a key-operated lock.

10. The security container of claim 6 in which both the till and the slip tray contain a plurality of compartments arranged and configured to hold valuables.

* * * * *

UNITED STATES PATENT AND TRADEMARK OFFICE

CERTIFICATE OF CORRECTION

PATENT NO. : 4,786,785

DATED : November 22, 1988

INVENTOR(S) : Dennis J. Felt

It is certified that error appears in the above-identified patent and that said Letters Patent is hereby corrected as shown below:

Column 4, line 66, delete "menas" and substitute --means--.

Column 5, line 8, delete "menas" and substitute --means--.

Column 5, line 28, delete "cliam" and substitute --claim--.

Column 5, line 29, delete "menas" and substitute --means--.

Column 5, line 36, delete "menas" and substitute --means--.

Column 5, line 42, delete "cliam" and substitute --claim--.

Column 5, line 52, after the word "second" insert --side--.

Column 6, line 9, delete "menas" and substitute --means--.

Column 6, line 17, after the word "removed" insert --from--.

Column 6, line 21, delete "menas" and substitute --means--.

UNITED STATES PATENT AND TRADEMARK OFFICE

CERTIFICATE OF CORRECTION

PATENT NO. : 4,786,785

DATED : November 22, 1988

INVENTOR(S) : Dennis J. Felt

It is certified that error appears in the above-identified patent and that said Letters Patent is hereby corrected as shown below:

Column 6, line 25, delete "menas" and substitute --means--.

Signed and Sealed this

Twenty-eighth Day of March, 1989

*Attest:*

DONALD J. QUIGG

*Attesting Officer*

*Commissioner of Patents and Trademarks*